US010619229B2

(12) United States Patent
Shinohara et al.

(10) Patent No.: US 10,619,229 B2
(45) Date of Patent: Apr. 14, 2020

(54) MANUFACTURING METHOD OF WEAR-RESISTANT IRON-BASED SINTERED ALLOY AND WEAR-RESISTANT IRON-BASED SINTERED ALLOY

(71) Applicants: TOYOTA JIDOSHA KABUSHIKI KAISHA, Toyota-shi, Aichi-ken (JP); FINE SINTER CO., LTD, Kasugai-shi, Aichi (JP)

(72) Inventors: Nobuyuki Shinohara, Tajimi (JP); Yuki Kamo, Okazaki (JP); Yoshihisa Ueda, Nagaokakyo (JP); Takanori Yoneda, Kasugai (JP); Yusaku Yoshida, Tajimi (JP); Masaru Sugimoto, Tajimi (JP)

(73) Assignees: TOYOTA JIDOSHA KABUSHIKI KAISHA, Toyata-shi, Aichi-ken (JP); FINE SINTER CO., LTD, Kasugai-shi, Aichi (JP)

( * ) Notice: Subject to any disclaimer, the term of this patent is extended or adjusted under 35 U.S.C. 154(b) by 190 days.

(21) Appl. No.: 15/703,387

(22) Filed: Sep. 13, 2017

(65) Prior Publication Data

US 2018/0080104 A1 Mar. 22, 2018

(30) Foreign Application Priority Data

Sep. 16, 2016 (JP) ..... 2016-181562

(51) Int. Cl.
*C22C 38/22* (2006.01)
*C22C 33/00* (2006.01)
(Continued)

(52) U.S. Cl.
CPC ..... *C22C 38/22* (2013.01); *B22F 1/0003* (2013.01); *B22F 3/16* (2013.01); *B22F 3/24* (2013.01);
(Continued)

(58) Field of Classification Search
CPC ..... C22C 38/22; C22C 38/20; C22C 33/0207; B22F 2301/35
See application file for complete search history.

(56) References Cited

U.S. PATENT DOCUMENTS 8,535,605 B2 * 9/2013 Orth ..... B22F 3/1007 419/25

FOREIGN PATENT DOCUMENTS

CN 101808768 A 8/2010
JP 60-258450 A 12/1985
(Continued)

OTHER PUBLICATIONS

Lindberg, Mechanical Properties of a Water Atomized Fe—Cr—Mo Powder and How to Sinter It. Advances in Powder Metallurgy & Particulate Materials / Adv. Powder Metall. Part. Mater. vol. 2. p. 7/229-7/243. (1999) (Year: 1999).*
(Continued)

*Primary Examiner* — Keith D. Hendricks
*Assistant Examiner* — Joshua S Carpenter
(74) *Attorney, Agent, or Firm* — Sughrue Mion, PLLC

(57) ABSTRACT

An iron alloy powder consists of, when the entirety thereof is assumed to be 100 mass %, Cr: 2.5 mass % to 3.5 mass %, Mo: 0.4 mass % to 0.6 mass %, and Fe and inevitable impurities as the balance, a mixed powder consisting of 15 mass % to 40 mass % of the iron alloy powder, 1.2 mass % to 1.8 mass % of a copper powder, 0.5 mass % to 1.0 mass % of a graphite powder, and a pure iron powder as the balance when the entire mixed powder is assumed to be 100 mass % is compacted into a compact, and the compact is sintered while transforming a structure derived from the pure iron powder into a structure in which a ferritic structure
(Continued)

and a pearlitic structure are mixed and transforming a structure derived from the iron alloy powder into a martensitic structure.

3 Claims, 7 Drawing Sheets

(51) Int. Cl.

| | |
|---|---|
| ***B22F 1/00*** | (2006.01) |
| ***B22F 3/16*** | (2006.01) |
| ***C22C 38/20*** | (2006.01) |
| ***C22C 33/02*** | (2006.01) |
| ***F01L 3/00*** | (2006.01) |
| ***F01L 3/02*** | (2006.01) |
| ***B22F 3/24*** | (2006.01) |

(52) U.S. Cl.
CPC ..... *C22C 33/006* (2013.01); *C22C 38/20* (2013.01); *F01L 3/00* (2013.01); *F01L 3/02* (2013.01); *B22F 2301/35* (2013.01); *B22F 2998/10* (2013.01); *C22C 33/02* (2013.01); *C22C 33/0257* (2013.01); *F01L 2101/00* (2013.01); *F01L 2103/00* (2013.01)

(56) References Cited

FOREIGN PATENT DOCUMENTS

| | | | | |
|---|---|---|---|---|
| JP | 61183440 | A | * | 8/1986 |
| JP | 2013-173961 | A | | 9/2013 |
| WO | 2009/030290 | A1 | | 3/2009 |

OTHER PUBLICATIONS

Davis, J.R. Metals Handbook, Desk Edition (2nd Edition) (pp. 329-340). ASM International. (1998) (Year: 1998).*

Espacenet translation of JPS61183440 retrieved on Sep. 12, 2019 (Year: 1986).*

* cited by examiner

200 μm

200 μm

MANUFACTURING METHOD OF WEAR-RESISTANT IRON-BASED SINTERED ALLOY AND WEAR-RESISTANT IRON-BASED SINTERED ALLOY

INCORPORATION BY REFERENCE

The disclosure of Japanese Patent Application No. 2016-181562 filed on Sep. 16, 2016 including the specification, drawings and abstract is incorporated herein by reference in its entirety.

BACKGROUND

1. Technical Field

The present disclosure relates to a manufacturing method of a wear-resistant iron-based sintered alloy containing hard particles for improving the wear resistance of the sintered alloy, and a wear-resistant iron-based sintered alloy.

2. Description of Related Art

Hitherto, a sintered alloy containing iron as the base may be applied to a valve seat or the like. The sintered alloy may contain hard particles in order to further improve wear resistance. In a case where the hard particles are contained, the hard particles are mixed with graphite particles and iron particles to form a powder, and this mixed powder is compacted into a compact. Thereafter, the compact is generally heated so as to be sintered into a sintered alloy.

As a manufacturing method of such a sintered alloy, a manufacturing method of a sintered alloy including compacting a mixed powder, in which a graphite powder, a Mo powder, a Co powder, a Ni powder, a CaF powder are mixed in a reduced iron powder as the base, into a compact and sintering the compact has been proposed. In the sintered alloy manufactured by the manufacturing method, hard particles consisting of a FeMo alloy and $CaF_2$ fine particles are dispersed in the base consisting of Fe—C—Co—Ni with an austenitic structure, a pearlitic structure, and a ferritic structure (for example, refer to Japanese Unexamined Patent Application Publication No. 60-258450 (JP 60-258450 A).

SUMMARY

In order to ensure corrosion resistance and wear resistance, Ni and Co are added to the wear-resistant iron-based sintered alloy manufactured by the manufacturing method described in JP 60-258450 A. However, since these metals are expensive, the cost of the wear-resistant iron-based sintered alloy increases.

The present disclosure provides a manufacturing method of a wear-resistant iron-based sintered alloy capable of improving corrosion resistance and wear resistance at a lower cost than the conventional wear-resistant iron-based sintered alloy, and a wear-resistant iron-based sintered alloy.

The inventors intensively and repeatedly conducted examinations, and as a result, paid attention to an iron alloy powder containing Cr and Mo in lower proportions than the conventional wear-resistant iron-based sintered alloy. It was thought that using such an iron alloy powder and a pure iron powder, regarding the structure of the pure iron powder, during sintering, a structure to become the iron base can be transformed into a structure in which a ferritic structure and a pearlitic structure are mixed, and the structure of iron alloy particles with improved hardenability by Cr and Mo can be transformed into a harder martensitic structure than the structure of the iron base. Accordingly, it was thought that the iron alloy particles transformed into the martensitic structure become hard particles and this can improve the wear resistance of the sintered alloy. Furthermore, it was thought that since Cr and Cu are added to the sintered alloy, the corrosion resistance of the sintered alloy can also be improved.

The present disclosure is based on this idea, and a first aspect of the present disclosure relates to a manufacturing method of a wear-resistant iron-based sintered alloy including: a forming step of compacting a mixed powder containing a pure iron powder, an iron alloy powder, a copper powder, and a graphite powder into a compact; and a sintering step of sintering the compact. The iron alloy powder consists of, when the entire iron alloy powder is assumed to be 100 mass %, Cr: 2.5 mass % to 3.5 mass %, Mo: 0.4 mass % to 0.6 mass %, and Fe and inevitable impurities as a balance, when the entire mixed powder is assumed to be 100 mass %, in the mixed powder, the proportion of the iron alloy powder is 15 mass % to 40 mass %, and the proportion of the copper powder is 1.2 mass % to 1.8 mass, the proportion of the graphite powder is 0.5 mass % to 1.0 mass %, the balance is the pure iron powder, and in the sintering step, a structure derived from the pure iron powder is a structure in which a ferritic structure and a pearlitic structure are mixed, and a structure derived from the iron alloy powder is a martensitic structure.

A second aspect of the present disclosure relates to a wear-resistant iron-based sintered alloy including: C: 0.5 mass % to 1.0 mass %; Cr: 0.45 mass % to 1.20 mass %; Mo: 0.075 mass % to 0.200 mass %; Cu: 1.2 mass % to 1.8 mass %; and Fe and inevitable impurities as a balance. In the wear-resistant iron-based sintered alloy, hard particles with a martensitic structure is dispersed in an iron base with a structure in which a ferritic structure and a pearlitic structure are mixed, C and Cu are contained in the iron base and the hard particles, Cr and Mo are contained at least in the hard particles, and when the entire wear-resistant iron-based sintered alloy is assumed to be 100 mass %, 15.3 mass % to 40.9 mass % of the hard particles are contained.

With the manufacturing method of a wear-resistant iron-based sintered alloy and the wear-resistant iron-based sintered alloy, the corrosion resistance and wear resistance can be improved at a lower cost than the conventional wear-resistant iron-based sintered alloy.

BRIEF DESCRIPTION OF THE DRAWINGS

Features, advantages, and technical and industrial significance of exemplary embodiments of the disclosure will be described below with reference to the accompanying drawings, in which like numerals denote like elements, and wherein.

DETAILED DESCRIPTION OF EMBODIMENTS

Figure 1:
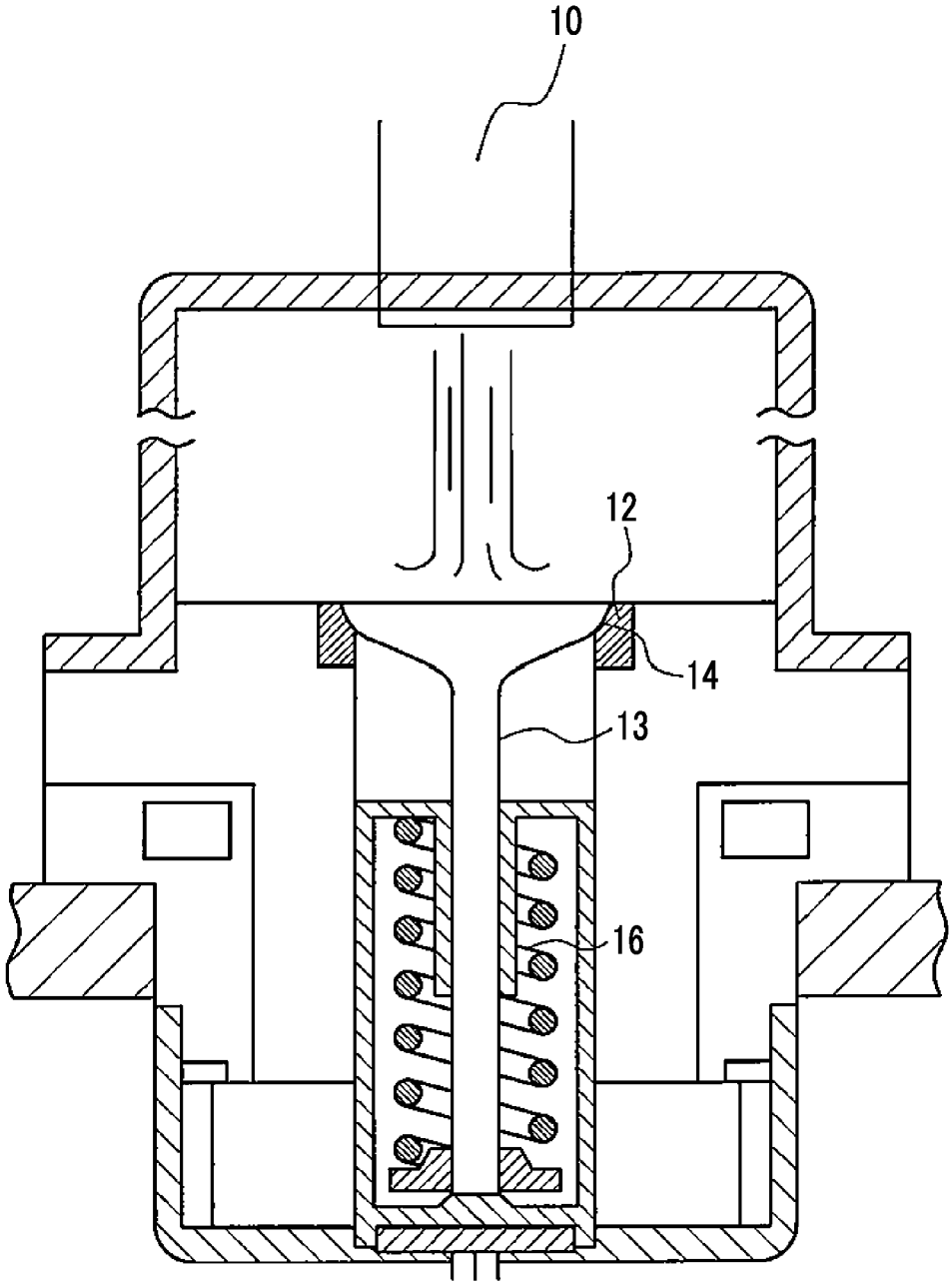
FIG. 1 is a schematic conceptual diagram of a wear resistance test used in examples and comparative examples.

Hereinafter, a wear-resistant iron-based sintered alloy (hereinafter, referred to as a sintered alloy) according to an embodiment of the present disclosure and a manufacturing method thereof will be described in detail.

The manufacturing method of the wear-resistant iron-based sintered alloy according to the embodiment includes a forming step of compacting a mixed powder containing a pure iron powder, an iron alloy powder, a copper powder, and a graphite powder into a compact, and a sintering step of sintering the compact. Hereinafter, these will be described in the order of the iron alloy powder, the pure iron powder, the copper powder, and the graphite powder, and the mixed powder in which these are mixed, the compact into which the mixed powder is compacted, and the sintered alloy into which the compact is sintered will be described.

1. Iron Alloy Powder

The iron alloy powder is a powder for the purpose of allowing a ferritic structure or a mixed structure of a ferritic structure and a pearlitic structure, which is the structure of the iron alloy powder, to be transformed into a martensitic structure during sintering thereby increasing the hardness with respect to the iron base of the sintered alloy and suppressing the abrasive wear of the sintered alloy.

The iron alloy powder consists of, when the entire iron alloy powder is assumed to be 100 mass %, Cr: 2.5 mass % to 3.5 mass %, Mo: 0.4 mass % to 0.6 mass %, and Fe and inevitable impurities as the balance. The iron alloy powder can be manufactured by preparing a molten metal having the above-mentioned composition blended in the above-mentioned ratio, and performing an atomization treatment of spraying the molten metal. As another method, a solidified body into which the molten metal is solidified may be pulverized by mechanical pulverization. The atomization treatment may be either a gas atomization treatment or a water atomization treatment. However, in consideration of sinterability and the like, a gas atomization treatment in which rounded particles are obtained is more preferable.

Here, the lower limit and the upper limit of the composition of the iron alloy powder described above can be appropriately changed according to the reason that the composition is limited, which will be described later, and furthermore, in consideration of hardness, solid lubricity, adhesion, cost, and the like within the range depending on the degree of emphasis on each of the characteristics of an applied member.

1-1. Cr: 2.5 mass % to 3.5 mass %

Cr contained in a range of 2.5 mass % to 3.5 mass % in the iron alloy powder improves the hardenability of the iron alloy particles, which are present in the compact and derived from the iron alloy powder, during sintering and allows the martensitic structure bearing hard particles harder than the iron base after the sintering to precipitate to the iron alloy particles. In addition, Cr forms Cr carbides in the iron alloy particles during the sintering and thus can improve the wear resistance of the sintered alloy. Furthermore, Cr forms a passive film on the surface of the sintered alloy and thus can improve the corrosion resistance of the sintered alloy.

Here, in a case where the Cr content is less than 2.5 mass %, the Cr content is too small, the hardenability of the iron alloy particles described above is insufficient, and the corrosion resistance of the sintered alloy is also insufficient. On the other hand, in a case where the Cr content exceeds 3.5 mass %, the Cr content is too high, the hardness of the iron alloy powder becomes too high, and the formability of the mixed powder into the compact is reduced. Accordingly, the density of the sintered alloy cannot be ensured, and the wear resistance of the sintered alloy may decrease. From this viewpoint, the Cr content is more preferably 2.8 mass % to 3.2 mass %.

1-2. Mo: 0.4 Mass % to 0.6 Mass %

Mo contained in a range of 0.4 mass % to 0.6 mass % in the iron alloy powder improves the hardenability of the iron alloy particles, which are present in the compact and derived from the iron alloy powder, during the sintering and allows the martensitic structure bearing the hard particles harder than the iron base after the sintering to precipitate to the iron alloy particles. In addition, Mo forms Mo carbides in the iron alloy particles during the sintering and thus can improve the wear resistance of the sintered alloy. Furthermore, Mo and Mo carbides solid-soluted in the hard particles are oxidized in a high temperature usage environment in which the sintered alloy is used and form Mo oxide films, thereby obtaining good solid lubricity for the sintered alloy.

Here, in a case where the Mo content is less than 0.4 mass %, the Mo content is too small, the hardenability of the iron alloy particles described above is insufficient, and sufficient solid lubricity described above cannot be expected. On the other hand, in a case where the Mo content exceeds 0.6 mass %, the Mo content is too high, the hardness of the iron alloy powder becomes too high, and the formability of the mixed powder into the compact is reduced. Accordingly, the density of the sintered alloy cannot be ensured, and the wear resistance of the sintered alloy may decrease. From this viewpoint, the Mo content is more preferably 0.45 mass % to 0.55 mass %.

1-3. Particle Size of Iron Alloy Powder

The particle size of the iron alloy powder can be appropriately selected according to the use and kind of the sintered alloy and the like. The particle size of the iron alloy powder is preferably in a range of 20 μm to 180 μm, and more preferably in a range of 44 μm to 105 μm. Here, "particle size" mentioned in this specification refers to the particle size measured according to JIS-Z 8801.

Here, in a case where the particle size of the iron alloy powder is less than 20 μm, the particle size thereof is too small, and thus the wear resistance of the sintered alloy may be impaired. On the other hand, in a case where the particle size of the iron alloy powder exceeds 180 μm, the particle size thereof is too large, and the machinability of the sintered alloy may decrease.

2. Pure Iron Powder

The pure iron powder that becomes the iron base of the sintered alloy is a powder made from pure iron, and pure iron consists of 99 mass % or more (more preferably, 99.9 mass % or more) of Fe and inevitable impurities as the balance. The pure iron powder is a powder with a ferritic structure, and becomes the iron base with a structure in which a ferritic structure and a pearlitic structure are mixed after sintering. The pure iron powder may be gas atomized powder, water atomized powder, or reduced powder. The particle size of the iron particles is preferably in a range of 180 μm or less.

3. Copper Powder

Cu forming the copper powder is an element that is melted during sintering and undergoes solid solution diffusion in the iron base and the iron alloy particles (the hard particles), thereby increasing the hardness of the iron base and improving the corrosion resistance of the sintered alloy. In the embodiment, the copper powder is a powder made from pure copper, and pure copper consists of 99 mass % or more (more preferably, 99.9 mass % or more) of Cu and inevitable impurities as the balance. The copper powder can be manufactured by the same method as the pure iron powder described above. The particle size of the copper powder is preferably in a range of 10 μm to 80 μm.

4. Graphite Powder

C forming the graphite powder is an element that undergoes solid solution diffusion in the iron base and the iron alloy particles (the hard particles) during sintering, thereby increasing the hardness thereof and improving the hardenability. The graphite powder may be a powder made from either natural graphite or artificial graphite, and may be a mixture thereof. The particle size of the graphite powder is preferably in a range of 1 μm to 45 μm. As a powder consisting of preferable graphite particles, graphite powder (CPB-S manufactured by Nippon Graphite Co., Ltd) and the like can be exemplified.

5. Mixing Ratio of Mixed Powder

The mixed powder is prepared to contain the pure iron powder, the iron alloy powder, the copper powder, and the graphite powder. When the entire mixed powder is assumed to be 100 mass %, in the mixed powder, the iron alloy powder is in a range of 15 mass % to 40 mass %, the copper powder is in a range of 1.2 mass % to 1.8 mass %, the graphite powder is in a range of 0.5 mass % to 1.0 mass %, and the balance is the pure iron powder.

5-1. Iron Alloy Powder: 15 Mass % to 40 Mass %

When the entire mixed powder is assumed to be 100 mass %, the iron alloy powder is in a range of 15 mass % to 40 mass %. Therefore, the abrasive wear resistance of the sintered alloy can be improved by the hard particles with the martensitic structure derived from the iron alloy powder. In addition, the corrosion resistance of the sintered alloy can be improved by Cr contained in the iron alloy powder. More preferably, when the entire mixed powder is assumed to be 100 mass %, the iron alloy powder is in a range of 15 mass % to 25 mass %.

In a case where the proportion of the iron alloy powder in the entire mixed powder is less than 15 mass %, the proportion of the iron alloy powder is too small, and thus the amount of the hard particles (martensitic structure) which are contained in the sintered alloy and derived from the iron alloy powder is insufficient. Therefore, the wear resistance of the sintered alloy decreases. Since the proportion of the iron alloy powder is too small, the Cr content in the sintered alloy is also small, and the corrosion resistance of the sintered alloy is also insufficient (for example, see Comparative Example 1 described later).

On the other hand, in a case where the proportion of the iron alloy powder in the entire mixed powder exceeds 40 mass %, the proportion of the iron alloy powder is too high, the proportion of the hard particles with the martensitic structure contained in the sintered alloy excessively increases, and the machinability decreases (for example, see Comparative Example 2 and the like, which will be described later).

5-2. Copper Powder: 1.2 Mass % to 1.8 Mass %

Since the copper powder is in a range of 1.2 mass % to 1.8 mass % in the entire mixed powder, the hardness of the iron base can be improved, and the corrosion resistance of the sintered alloy can be improved. More preferably, When the entire mixed powder is assumed to be 100 mass %, the copper powder is in a range of 1.4 mass % to 1.6 mass %.

In a case where the proportion of the copper powder in the entire mixed powder is less than 1.2 mass %, the proportion of the copper powder is too small, and thus the hardness of the iron base of the sintered alloy cannot be ensured. In addition, when the sintered alloy and metal are brought into contact with each other, the iron base may be plastically deformed and easily pulled off, resulting in adhesive wear. Furthermore, the effect of corrosion resistance by copper cannot be sufficiently obtained, and the corrosion resistance of the sintered alloy may decrease (for example, see Comparative Example 3 and the like, which will be described later).

On the other hand, in a case where the proportion of the copper powder in the entire mixed powder exceeds 1.8 mass %, the proportion of the copper powder is too high, and Mo oxide films and the like are less likely to be formed on the surface of the sintered alloy in a high temperature usage environment due to Cu. Therefore, when the sintered alloy and metal are brought into contact with each other, adhesive wear occurs, and the wear resistance decreases (for example, see Comparative Examples 4 and 5 and the like, which will be described later).

5-3. Graphite Powder: 0.5 Mass % to 1.0 Mass %

Since the graphite powder is contained in a proportion of 0.5 mass % to 1.0 mass % in the entire mixed powder, the hardness of the iron base can be improved, the hardenability during sintering can be improved, and the wear resistance of the sintered alloy can be increased. More preferably, the graphite powder is in a range of 0.8 mass % to 0.9 mass % when the entire mixed powder is assumed to be 100 mass %.

In a case where the proportion of the graphite powder in the entire mixed powder is less than 0.5 mass %, the proportion of the graphite powder is too small, and thus the amount of the ferritic structure in the iron base of the sintered alloy is large, resulting in a reduction in the hardness of the sintered alloy. Accordingly, the wear resistance of the sintered alloy decreases (for example, see Comparative Example 6 and the like, which will be described later).

On the other hand, in a case where the proportion of the graphite powder in the entire mixed powder exceeds 1.0 mass %, the proportion of the graphite powder is too high, and a large amount of Cr carbides and Mo carbides are produced in the sintered alloy, resulting in a reduction in the corrosion resistance of the sintered alloy (for example, see Comparative Example 7 and the like, which will be described later).

6. Manufacturing Method of Wear-Resistant Iron-Based Sintered Alloy

The mixed powder obtained as described above is compacted into a compact using a die. In the compact, the pure iron powder, the iron alloy powder, the copper powder, and the graphite powder are contained in the same proportions as those in the mixed powder. Next, the compact is sintered (sintering step).

Specifically, in the sintering step, the compact is heated under the condition that the heating temperature is set to 1050° C. to 1200° C. and the heating time is set to 10 minutes to 60 minutes, and the compact heated under the above condition is cooled at a cooling rate of 20° C./min to 300° C./min. The sintering atmosphere may be a non-oxidizing atmosphere such as an inert gas atmosphere, and the non-oxidizing atmosphere may be a nitrogen gas atmosphere, an argon gas atmosphere, or a depressurized atmosphere (an atmosphere close to vacuum).

Accordingly, carbon and copper undergo solid solution diffusion in pure iron particles of the compact derived from the pure iron powder and iron alloy particles of the compact derived from the iron alloy powder. Here, since the iron alloy particles contain a small amount of Cr and Mo, the hardenability thereof is higher than that of the pure iron particles.

Therefore, after heating the compact, when the compact is cooled, the structure of the pure iron particles can be transformed into a structure in which a ferritic structure and a pearlitic structure are mixed, and the structure of the iron alloy particles derived from the iron alloy powder can be transformed into a martensitic structure.

In the embodiment, the structure of the pure iron powder is a ferritic structure before heating, and the structure of the alloy powder is a ferritic structure or a mixed structure of a ferritic structure and a pearlitic structure before heating. These are transformed into an austenitic structure in a heated state during sintering. Thereafter, when the heated compact (sintered alloy) is cooled, these are transformed into the above-described structures.

As described above, the pure iron particles with the structure in which the ferritic structure and the pearlitic structure are mixed become the iron base of the sintered alloy. On the other hand, the iron alloy particles with the martensitic structure become hard particles contained in the sintered alloy. Here, the hard particles are particles harder than the iron base.

Here, in the sintering step, in a case where the heating temperature is lower than 1050° C., there is a concern that Cu may not enter a liquid-phase state and unmelted Cu may remain in the sintered alloy. In a case where the heating temperature exceeds 1200° C., there is a concern that the compact may be melted during the sintering.

In the sintering step, in a case where the heating time is shorter than 10 minutes, the compact may be insufficiently sintered. In a case where the sintering time exceeds 60 minutes, the effect of sinterability is not exhibited any longer, grains of each structure grow, and the strength of the sintered alloy may decrease.

In the sintering step, in a case where the cooling rate is less than 20° C./min, there is a concern that the structure of the iron alloy particles may be less likely to be transformed into the martensitic structure, and the wear resistance of the sintered alloy may decrease. On the other hand, in a case where the cooling rate exceeds 300° C./min, there is a concern that the structure of the pure iron particles to become the iron base may also be transformed into a martensitic structure, and the machinability of the sintered alloy decreases.

7. Wear-Resistant Iron-Based Sintered Alloy

When the entire sintered alloy is assumed to be 100 mass %, the sintered alloy obtained as described above consists of C: 0.5 mass % to 1.0 mass %, Cr: 0.45 mass % to 1.20 mass %, Mo: 0.075 mass % to 0.200 mass %, Cu: 1.2 mass % to 1.8 mass %, and Fe and inevitable impurities as the balance. In the sintered alloy, the hard particles with the martensitic structure are dispersed in the iron base with the ferritic structure and the pearlitic structure. C and Cu are contained in the iron base and the hard particles, and Cr and Mo are contained in at least the hard particles. Here, most of Cr and Mo are present in the hard particles or at the interfaces therebetween, and a small amount of Cr and Mo are present in the vicinity of the interface with the iron base. When the entire sintered alloy is assumed to be 100 mass %, the hard particles are contained in a proportion of 15.3 mass % to 40.9 mass %.

7-1. C: 0.5 Mass % to 1.0 Mass %

By setting the proportion of C contained in the sintered alloy to 0.5 mass % to 1.0 mass %, the wear resistance of the sintered alloy can be increased. In a case where the C content is less than 0.5 mass %, the carbon content of the iron base is too small, and thus the amount of the ferritic structure is large, resulting in a reduction in the wear resistance of the sintered alloy. On the other hand, when the C content exceeds 1.0 mass %, a large amount of Cr carbides and Mo carbides are produced in the sintered alloy, resulting in a reduction in the corrosion resistance of the sintered alloy. When the sintered alloy is assumed to be 100 mass %, the C content is more preferably 0.8 mass % to 0.9 mass %.

7-2. Cr: 0.45 Mass % to 1.20 Mass %

By setting the proportion of Cr contained in the sintered alloy to 0.45 mass % to 1.20 mass %, the wear resistance and the corrosion resistance of the sintered alloy can be increased. In a case where the Cr content is less than 0.45 mass %, the Cr content is too small, and thus the effect of the wear resistance and corrosion resistance by Cr cannot be sufficiently exhibited. On the other hand, when the Cr content exceeds 1.20 mass %, the Cr content is too high, and thus the machinability of the sintered alloy may decrease. When the sintered alloy is assumed to be 100 mass %, the Cr content is more preferably 0.5 mass % to 1.0 mass %.

7-3. Mo: 0.075 Mass % to 0.200 Mass %

By setting the proportion of Mo contained in the sintered alloy to 0.075 mass % to 0.200 mass %, the wear resistance and corrosion resistance of the sintered alloy can be increased. In a case where the Mo content is less than 0.075 mass %, the Mo content is too small, and thus the wear resistance due to Mo carbides cannot be sufficiently exhibited. In addition, the solid lubricity in a high temperature usage environment due to Mo oxides cannot be sufficiently exhibited. On the other hand, in a case where the Mo content exceeds 0.200 mass %, the Mo content is too high, and thus the wear resistance of the sintered alloy may decrease. When the sintered alloy is assumed to be 100 mass %, the Mo content is more preferably 0.084 mass % to 0.1833 mass %.

7-4. Cu: 1.2 Mass % to 1.8 Mass %

By setting the proportion of Cu contained in the sintered alloy to 1.2 mass % to 1.8 mass %, the hardness of the iron base can be improved, and thus the corrosion resistance of the sintered alloy can be improved. In a case where the Cu content is less than 1.2 mass %, the Cu content is too small, and the hardness of the iron base of the sintered alloy cannot be ensured. In addition, when the sintered alloy and metal are brought into contact with each other, the iron base may be plastically deformed and easily pulled off, resulting in adhesive wear. In addition, the corrosion resistance of the sintered alloy may decrease. On the other hand, in a case where the Cu content exceeds 1.8 mass %, the Cu content is too high, and thus Mo oxide films and the like are less likely to be formed on the surface of the sintered alloy in a high temperature usage environment due to Cu. Therefore, when the sintered alloy and metal are brought into contact with each other, adhesive wear occurs, and the wear resistance decreases. When the sintered alloy is assumed to be 100 mass %, the Cu content is more preferably in a range of 1.4 mass % to 1.6 mass %.

7.5. Hard Particles: 15.3 Mass % to 40.9 Mass %

On the premise of the above-mentioned composition, in the sintered alloy, the hard particles with the martensitic structure are dispersed in the iron base with the ferritic structure and the pearlitic structure. As described above, the hard particles are particles with the martensitic structure derived from the iron alloy powder (the iron alloy particles of the compact). In addition, the iron base is a base with the structure in which the ferritic structure and the pearlitic structure are mixed, which is derived from the pure iron powder (the pure iron particles of the compact). In addition, since the hard particles have the martensitic structure, the hard particles are harder than the iron base with the structure in which the ferritic structure and the pearlitic structure are mixed.

By causing the hard particles contained in the sintered alloy to be contained in a proportion of 15.3 mass % to 40.9 mass % in the entire sintered alloy, the machinability of the sintered alloy can be ensured while ensuring the wear resistance of the sintered alloy. In a case where the proportion of the hard particles contained in the sintered alloy is less than 15.3 mass % in the entire sintered alloy, the proportion of the hard particles is too small, and thus the wear resistance of the sintered alloy decreases. On the other hand, in a case where the proportion of the hard particles in the entire mixed powder exceed 40.9 mass %, the proportion of the hard particles is too high, and thus the proportion of the hard particles with the martensitic structure contained in the sintered alloy increases, resulting in a reduction in the machinability of the sintered alloy. When the sintered alloy is assumed to be 100 mass %, the proportion of the iron alloy powder is more preferably in a range of 15.3 mass % to 25.5 mass %.

8. Applications of Wear-Resistant Iron-Based Sintered Alloy

The sintered alloy obtained in the above-described manufacturing method has higher mechanical strength and wear resistance than those of the conventional wear-resistant iron-based sintered alloy in a high temperature usage environment. For example, the sintered alloy can be suitably used for a valve system (for example, a valve seat or a valve guide) of an internal combustion engine using compressed natural gas or liquefied petroleum gas as a fuel, a waste gate valve of a turbocharger, and the like, which are subjected to a high temperature usage environment.

For example, in a case where a valve seat of an exhaust valve of an internal combustion engine is formed of the sintered alloy, even when a form of wear in which adhesive wear during contact between the valve seat and the valve and abrasive wear during sliding of the two are mixed is exhibited, the wear resistance of the valve seat can be further improved compared to that in the related art. Particularly in a usage environment in which compressed natural gas or liquefied petroleum gas is used as a fuel, it is difficult to form a Mo oxide film. However, even in this environment, the adhesive wear can be reduced.

Hereinafter, examples in which the present disclosure is concretely embodied and comparative examples will be described.

Example 1: Optimal Amount (Lower Limit) of Iron Alloy Powder

A sintered alloy according to Example 1 was manufactured by the following manufacturing method. As the pure iron powder, atomized iron powder (ASC100.29 manufactured by Höganäs AB) was prepared. The particle size of the pure iron powder was 20 μm to 180 μm. As the iron alloy powder, an iron alloy powder (manufactured by Höganäs AB) consisting of Cr: 3.0 mass %, Mo: 0.5 mass %, and Fe and inevitable impurities as the balance (Fe-3.0Cr-0.5Mo) when the entire iron alloy powder was assumed to be 100 mass %, which was manufactured by an atomization method was prepared. The particle size of the iron alloy powder was 180 μm or less. Furthermore, a copper powder (CE-20-NP manufactured by FUKUDA METAL FOIL & POWDER Co., LTD.) and graphite powder (CPB-S manufactured by Nippon Graphite Industries, Ltd.) were prepared.

By mixing these powders at the ratio shown in Table 1, a mixed powder was prepared. Specifically, when the entire mixed powder was assumed to be 100 mass %, the mixed powder was prepared by mixing 15 mass % of the iron alloy powder, 1.5 mass % of the copper powder, 0.7 mass % of the graphite powder, and the pure iron powder as the balance (specifically, 82.8 mass %) in these proportions by a V-type mixer for 30 minutes.

Next, using a die, the obtained mixed powder was compacted into a test piece (compact) having a ring shape at a pressure of 784 MPa according to each test described later. The compact was heated in an inert atmosphere (nitrogen gas atmosphere) at 1120° C. for 60 minutes and sintered by cooling at a cooling rate of 50° C./min, thereby preparing a test piece of the sintered alloy according to Example 1.

Example 2: Optimal Amount (Upper Limit) of Iron Alloy Powder

A test piece of a sintered alloy was prepared in the same manner as in Example 1. Example 2 is an example for evaluating the optimal amount of the iron alloy powder. Example 2 is different from Example 1 in that as shown in Table 1, the iron alloy powder was added to the entire mixed powder in a proportion of 40 mass %.

Examples 3 and 4: Optimal Amount of Copper Powder

A test piece of a sintered alloy was prepared in the same manner as in Example 1. Examples 3 and 4 are examples for evaluating the optimal amount of the copper powder. Examples 3 and 4 are different from Example 1 in that as shown in Table 1, the iron alloy powder was added in a proportion of 20 mass % in the entire mixed powder. Furthermore, Examples 3 and 4 are different from Example 1 in that as shown in Table 1, the copper powder was added to the entire mixed powder sequentially in a proportion of 1.2 mass % and 1.8 mass %.

Examples 5 and 6: Optimal Amount of Graphite Powder

A test piece of a sintered alloy was prepared in the same manner as in Example 1. Examples 5 and 6 are examples for evaluating the optimal amount of the graphite powder. Examples 5 and 6 are different from Example 1 in that as shown in Table 1, the iron alloy powder was added in a proportion of 20 mass % in the entire mixed powder. Furthermore, Examples 5 and 6 are different from Example 1 in that as shown in Table 1, the graphite powder was added to the entire mixed powder sequentially in a proportion of 0.5 mass % and 1.0 mass %.

Comparative Examples 1 and 2: Comparative Examples of Optimal Amount of Iron Alloy Powder A test piece of a sintered alloy was prepared in the same manner as in Example 1. Comparative Examples 1 and 2 are comparative examples for evaluating the optimal addition amount of the iron alloy powder. Comparative Examples 1 and 2 are different from Example 1 in that as shown in Table 1, the iron alloy powder was added to the entire mixed powder sequentially in a proportion of 5 mass % and 60 mass %.

Comparative Examples 3 to 5: Comparative Examples of Optimal Amount of Copper Powder A test piece of a sintered alloy was prepared in the same manner as in Example 1. Comparative Examples 3 to 5 are comparative examples for evaluating the optimal addition amount of the copper powder. Comparative Examples 3 to 5 are different from Example 1 in that as shown in Table 1, the iron alloy powder was added to the entire mixed powder in a proportion of 20 mass %. Furthermore, Comparative Examples 3 to 5 are different from Example 1 in that as shown in Table 1, the copper powder was added to the entire mixed powder sequentially in a proportion of 0.5 mass %, 3.0 mass %, and 9.0 mass %.

Comparative Examples 6 and 7: Comparative Examples of Optimal Amount of Graphite Powder A test piece of a sintered alloy was prepared in the same manner as in Example 1. Comparative Examples 6 and 7 are comparative examples for evaluating the optimal addition amount of the graphite powder. Comparative Examples 6 and 7 are different from Example 1 in that as shown in Table 1, the iron alloy powder was added to the entire mixed powder in a proportion of 20 mass %. Furthermore, Comparative Examples 6 and 7 are different from Example 1 in that as shown in Table 1, the graphite powder was added to the entire mixed powder sequentially in a proportion of 0.3 mass % and 1.5 mass %.

Comparative Example 8

A test piece of a sintered alloy was prepared in the same manner as in Example 1. Comparative Example 8 is different from Example 1 in that as the mixed powder, a mixed powder consisting of 10 mass % of an iron alloy powder (Fe-75Mo), 6.0 mass % of a cobalt powder, 6.0 mass % of a nickel powder, 0.5 mass % of a graphite powder, and a pure iron powder as the balance was used. In addition, the iron alloy powder (Fe-75Mo) is a powder containing Mo in a proportion of 75 mass % in the entire iron alloy powder. Comparative Example 8 is a sintered alloy manufactured in the related art.

Wear Resistance Test

Using the testing machine illustrated in FIG. 1, a wear resistance test was conducted on a test piece of the valve seat of the sintered alloys according to Examples 1 to 6 and Comparative Examples 1 to 8 to evaluate the wear resistance thereof. In this test, as illustrated in FIG. 1, using a propane gas burner 10 as a heating source, a sliding part between a ring-shaped valve seat (test piece) 12 made of the sintered alloy and a valve face 14 of a valve 13 was subjected to a propane gas combustion atmosphere. The valve face 14 is obtained by performing a nitriding treatment on SUH3 (SEA standards). By controlling the surface temperature of the valve seat 12 to 200° C., applying a load of 25 kgf by a spring 16 during contact between the valve seat 12 and the valve face 14, and bringing the valve seat 12 and the valve face 14 into contact with each other at a rate of 3250 times/min, a wear test was conducted for 8 hours. The total amount of the axial wear depths of the valve seat 12 and the valve face 14 after the wear test was measured as an axial wear amount (wear amount). The results are shown in Table 1. In Table 1, the wear amount ratio of Examples 1 to 6 and Comparative Examples 1 to 7 with respect to the wear amount of Comparative Example 8 were calculated.

Figure 5:
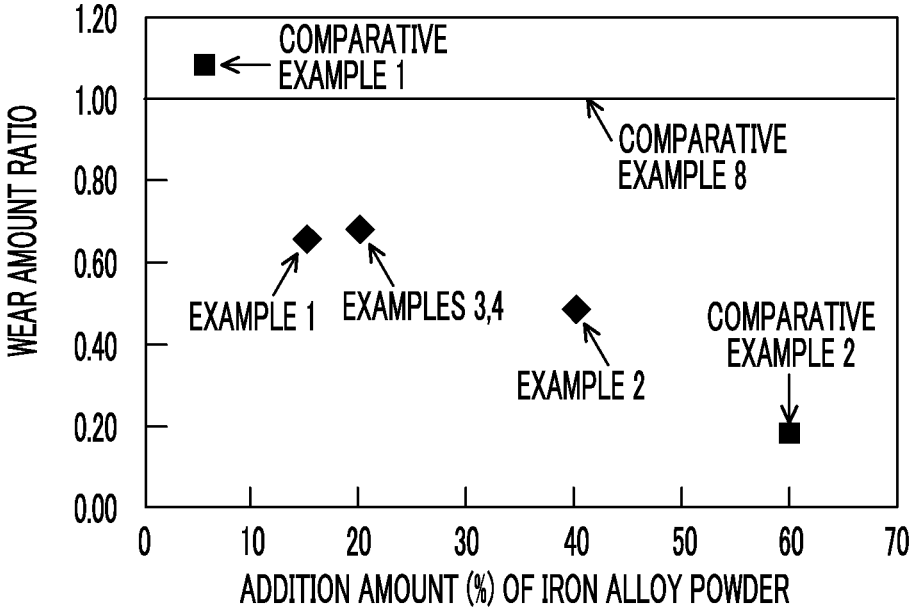
FIG. 5 is a graph showing the relationship between the addition amount of an iron alloy powder and the wear amount ratio of a sintered alloy with respect to Comparative Example 8, according to Examples 1 to 4 and Comparative Examples 1 and 2.
Figure 7:
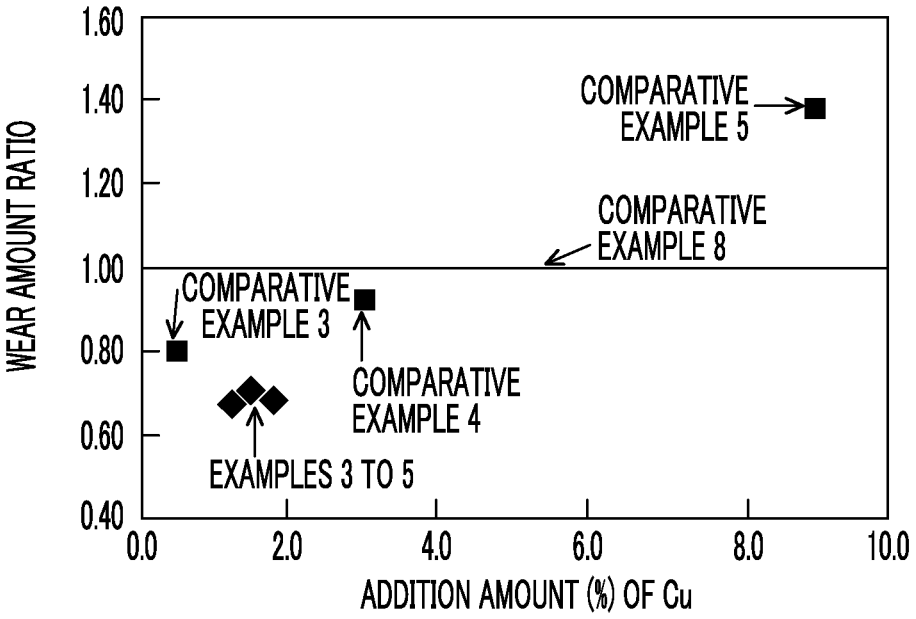
FIG. 7 is a graph showing the relationship between the addition amount of Cu of a sintered alloy and the wear amount ratio of the sintered alloy with respect to Comparative Example 8, according to Examples 3 to 5 and Comparative Examples 3 to 5.

FIG. 5 is a graph showing the relationship between the addition amount of the iron alloy powder and the wear amount ratio of the sintered alloy with respect to Comparative Example 8, according to Examples 1 to 4 and Comparative Examples 1 and 2. FIG. 7 is a graph showing the relationship between the addition amount of Cu of the sintered alloy and the wear amount ratio of the sintered alloy with respect to Comparative Example 8, according to Examples 3 to 5 and Comparative Examples 3 to 5.

Machinability Evaluation Test

Figure 2:
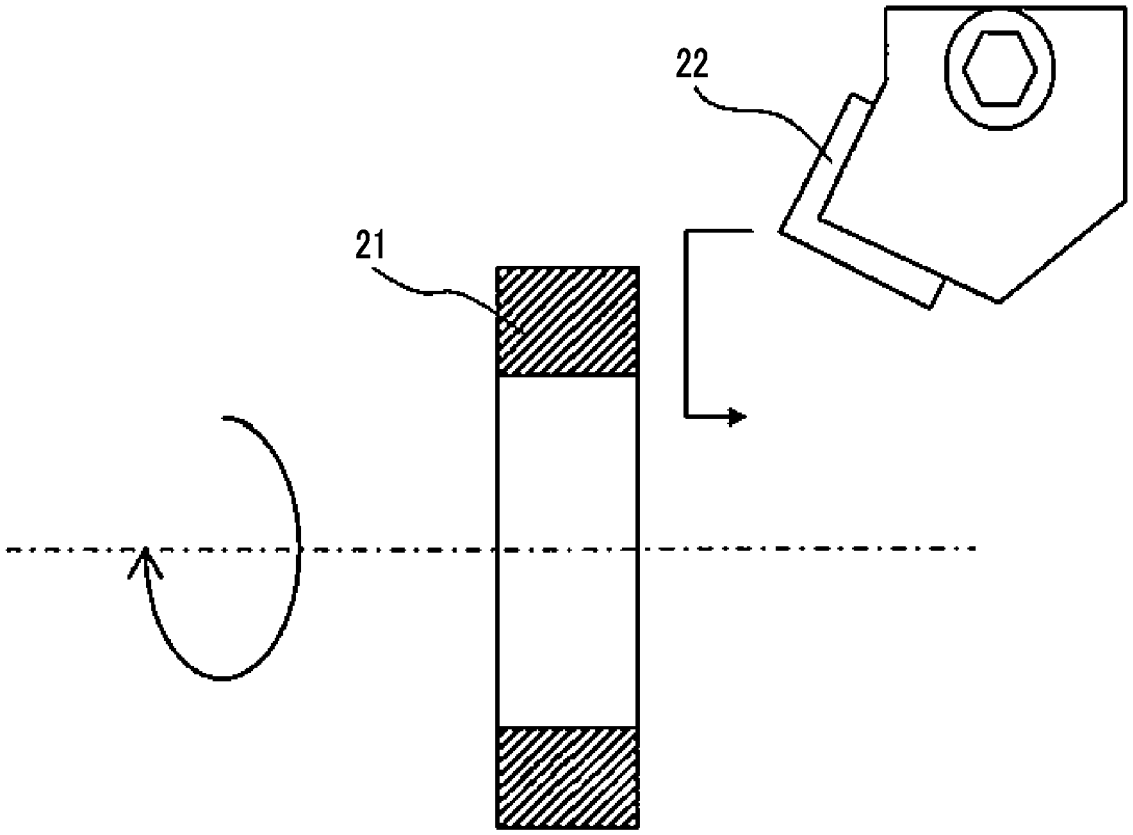
FIG. 2 is a schematic conceptual diagram of a machinability evaluation test used in the examples and the comparative examples.

Using the testing machine illustrated in FIG. 2, a machinability evaluation test was conducted on the test pieces of the sintered alloys according to Examples 1 to 6 and Comparative Examples 1 to 8 to evaluate the machinability thereof. In this test, six test pieces 21 having an outer diameter of 30 mm, an inner diameter of 22 mm, and an overall length of 9 mm were prepared for each of Examples 1 to 6 and Comparative Examples 1 to 8. Using an NC lathe, the test piece 21 rotated at a rotation speed of 970 rpm was traverse-cut by a cemented carbide cutting tool 22 coated with titanium aluminum nitride at a depth of cut of 0.3 mm, a feed of 0.08 mm/rev, and a cutting length of 320 m. Thereafter, the maximum wear depth of the flank of the cutting tool 22 was measured as a cutting tool wear amount by an optical microscope. The results are shown in Table 1.

Corrosiveness Evaluation Test

Figure 3:
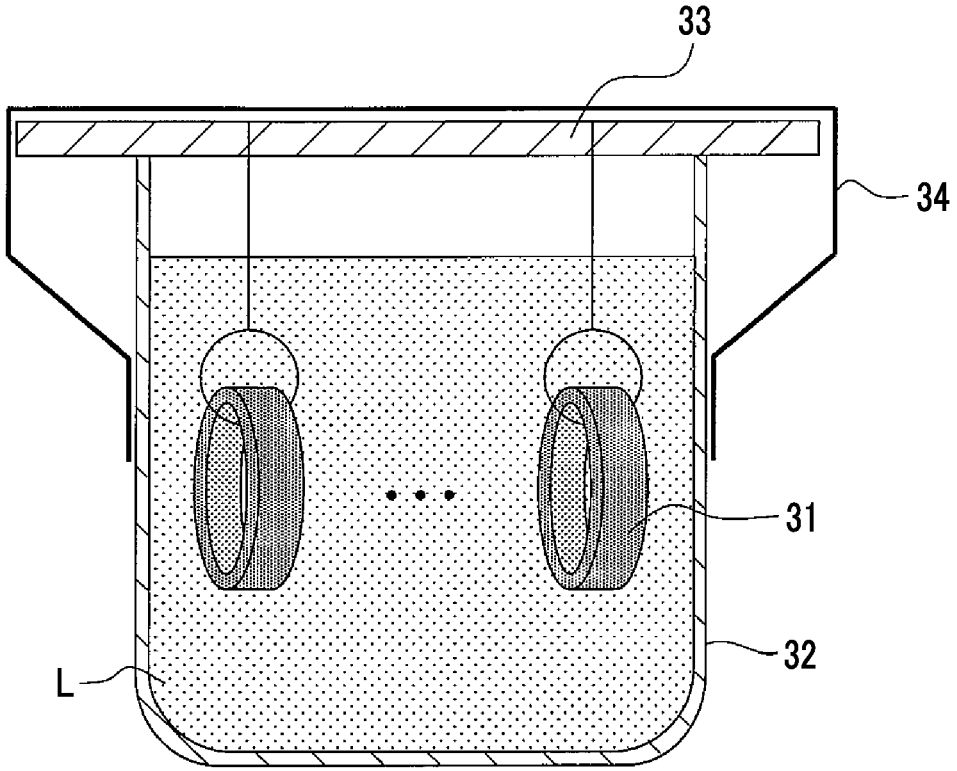
FIG. 3 is a schematic conceptual diagram of a corrosion evaluation test used in the examples and the comparative examples.

Using the testing machine illustrated in FIG. 3, a corrosiveness evaluation test was conducted on the test pieces of the sintered alloys according to Examples 1 to 6 and Comparative Examples 1, 3, and 6 to 8 to evaluate the corrosiveness thereof. Specifically, for each of Examples 1 to 6 and Comparative Examples 1, 3, and 6 to 8, a ring-shaped test piece 31 having an outer diameter of 29.21 mm, an inner diameter of 20 mm, and a length of 6.5 mm was prepared. As shown in FIG. 3, the prepared test piece 31 was suspended from a beam 33, and in a state of being suspended from the beam 33, the test piece 31 was immersed in a corrosive liquid L (pH 2.62) in a container 32. The container 32 was covered with a cover 34. The immersion condition was set to a condition of one hour and 70° C., and after being immersed under this condition, the test piece 31 was left in the air for 15 minutes. One cycle was set a period from the immersion of the test piece into the corrosive liquid to the leaving in the air, and each test piece was subjected to 25 cycles. A change in weight before and after the 25 cycles was measured, and this was determined as a corrosion weight loss. In Table 1, the corrosion weight loss ratio with respect to the corrosion weight loss of Comparative Example 8 was calculated for Examples 1 to 6 and Comparative Examples 1, 3, 6, and 7. The results are shown in Table 1.

Figure 6:
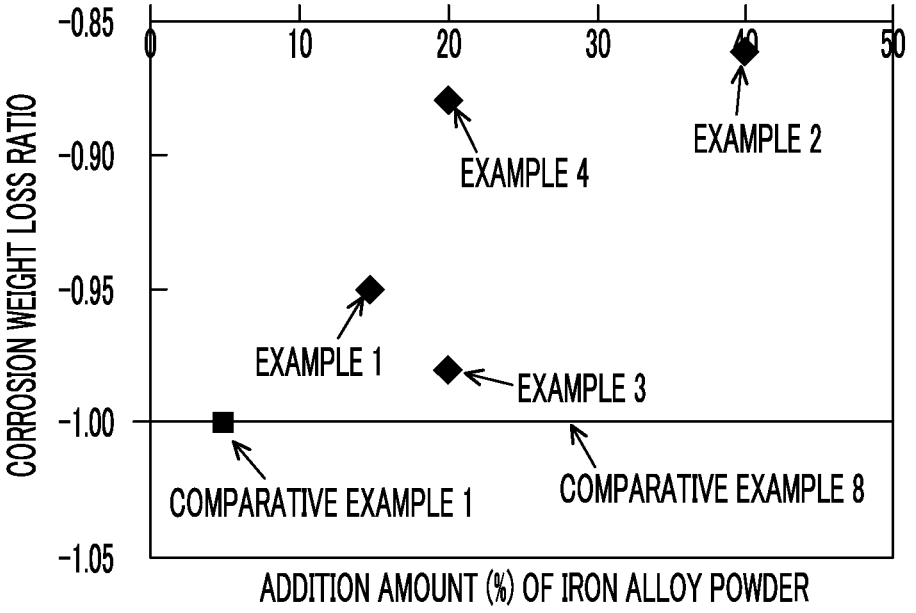
FIG. 6 is a graph showing the relationship between the addition amount of an iron alloy powder and the corrosion weight loss ratio of a sintered alloy with respect to Comparative Example 8, according to Examples 1 to 4 and Comparative Example 1.
Figure 8:
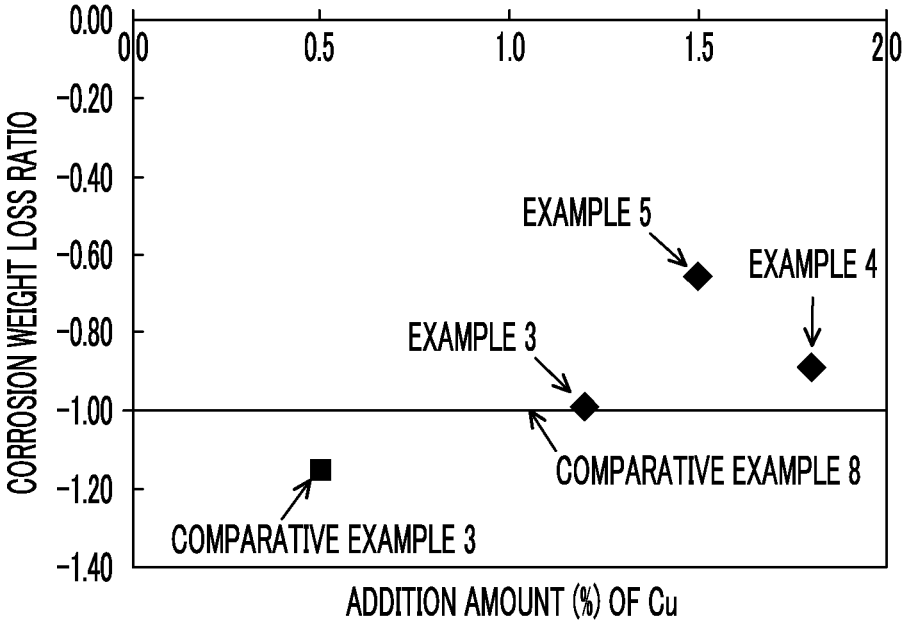
FIG. 8 is a graph showing the relationship between the addition amount of Cu of a sintered alloy and the corrosion weight loss ratio of a sintered alloy with respect to Comparative Example 8, according to Examples 3 to 5 and Comparative Example 3.
Figure 9:
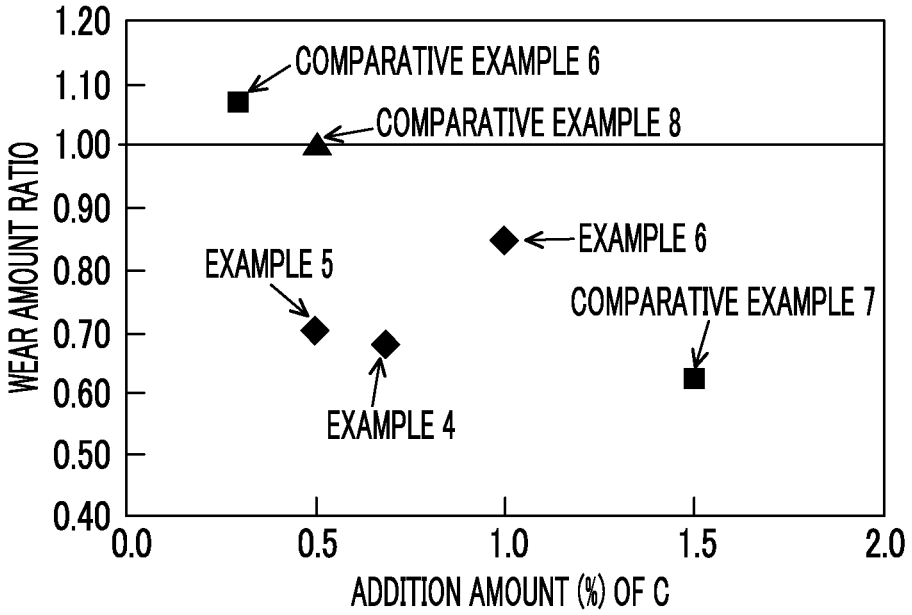
FIG. 9 is a graph showing the relationship between the addition amount of C of a sintered alloy and the wear amount ratio of the sintered alloy with respect to Comparative Example 8, according to Examples 4 to 6 and Comparative Examples 6 and 7.

FIG. 6 is a graph showing the relationship between the addition amount of the iron alloy powder and the corrosion weight loss ratio of the sintered alloy with respect to Comparative Example 8, according to Examples 1 to 4 and Comparative Example 1. FIG. 8 is a graph showing the relationship between the addition amount of Cu of the sintered alloy and the corrosion weight loss ratio of the sintered alloy with respect to Comparative Example 8, according to Examples 3 to 5 and Comparative Example 3. FIG. 9 is a graph showing the relationship between the addition amount of C of the sintered alloy and the wear amount ratio of the sintered alloy with respect to Comparative Example 8, according to Examples 4 to 6 and Comparative Examples 6 and 7.

Structure Observation and Proportion of Hard Particles

Figure 4A:
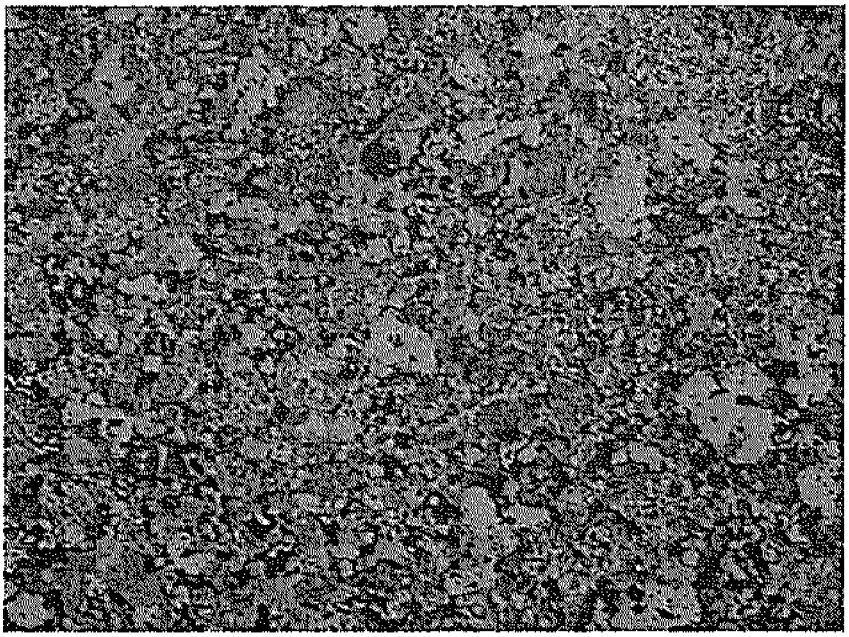
FIG. 4A is a micrograph of a sintered alloy according to Example 1.
Figure 4B:
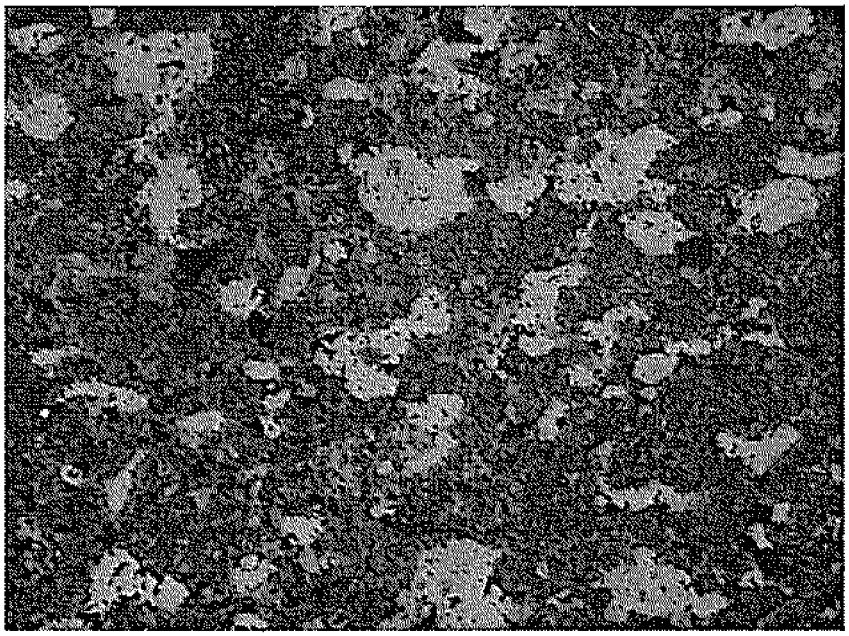
FIG. 4B is a micrograph of a sintered alloy according to Example 2.

The micrographs of the test pieces of Examples 1 and 2 were observed with a microscope. As a result, FIGS. 4A and 4B are obtained. FIG. 4A is a micrograph of the sintered alloy according to Example 1, and FIG. 4B is a micrograph of the sintered alloy according to Example 2. From FIGS. 4A and 4B, it could be seen that hard particles with the martensitic structure (the black part in the photograph) were dispersed in the sintered alloy. In addition, the structure of the iron base was a structure in which a ferritic structure and a pearlitic structure were mixed (gray and white parts in the photograph).

As described above, since Cr and Mo were contained in the iron alloy powder in order to improve hardenability, the hard particles were derived from the iron alloy powder. Furthermore, Cu and C were uniformly dispersed in the sintered alloy during sintering, and Cr and Mo were alloyed and retained in the iron alloy particles. Therefore, calculation thereof was performed as follows.

First, the ratio of the proportion (mass %) of the iron alloy powder to the sum of the proportion (mass %) of the pure iron powder and the proportion (mass %) of the iron alloy powder added to the mixed powder was calculated. Next, the proportions (mass %) of Cu and C diffused in the iron alloy particles were calculated by multiplying the ratio by the sum of the proportion (mass %) of the copper powder and the proportion (mass %) of the graphite powder added to the mixed powder. A value obtained by adding the proportion (mass %) of the iron alloy particles to the proportions (mass %) of Cu and C diffused therein was used as the proportion (mass %) of the hard particles in the sintered alloy. The results are shown in Table 1.

From the proportion of each of the powders added to the mixed powder, each component contained in the sintered alloy was calculated. The results are shown in Table 1. As is apparent from Table 1, the content of each component of the sintered alloy according to Examples 1 to 6 satisfies the range of the content of the corresponding component of the sintered alloy according to the present disclosure (C: 0.5 mass % to 1.0 mass %, Cr: 0.45 mass % to 1.20 mass %, Mo: 0.075 mass % to 0.200 mass %, and Cu: 1.2 mass % to 1.8 mass %).

TABLE 1

| | Blending | Composition (mass %) | | | | | | | Corrosion weight loss | Wear amount | Cutting tool wear amount | Hard particles proportion |
|---|---|---|---|---|---|---|---|---|---|---|---|---|
| | (%) = mass % | Fe | Cr | Mo | Cu | C | Co | Ni | ratio | ratio | (μm) | (mass %) |
| EXAMPLE 1 | Fe-15% (iron alloy)-1.5% Cu-0.7% C | Bal. | 0.45 | 0.075 | 1.5 | 0.7 | — | — | −0.95 | 0.65 | 0.04 | 15.3 |
| EXAMPLE 2 | Fe-40% (iron alloy)-1.5% Cu-0.7% C | Bal. | 1.20 | 0.200 | 1.5 | 0.7 | — | — | −0.86 | 0.48 | 0.09 | 40.9 |
| EXAMPLE 3 | Fe-20% (iron alloy)-1.2% Cu-0.7% C | Bal. | 0.60 | 0.100 | 1.2 | 0.7 | — | — | −0.98 | 0.68 | 0.04 | 20.4 |
| EXAMPLE 4 | Fe-20% (iron alloy)-1.8% Cu-0.7% C | Bal. | 0.60 | 0.100 | 1.8 | 0.7 | — | — | −0.88 | 0.68 | 0.05 | 20.5 |
| EXAMPLE 5 | Fe-20% (iron alloy)-1.5% Cu-0.5% C | Bal. | 0.60 | 0.100 | 1.5 | 0.5 | — | — | −0.65 | 0.70 | 0.04 | 20.4 |
| EXAMPLE 6 | Fe-20% (iron alloy)-1.5% Cu-1.0% C | Bal. | 0.60 | 0.100 | 1.5 | 1.0 | — | — | −0.95 | 0.85 | 0.05 | 20.5 |
| COMPARATIVE EXAMPLE 1 | Fe-5% (iron alloy)-1.5% Cu-0.7% C | Bal. | 0.30 | 0.025 | 1.5 | 0.7 | — | — | −1.00 | 1.08 | 0.04 | 5.1 |
| COMPARATIVE EXAMPLE 2 | Fe-60% (iron alloy)-1.5% Cu-0.7% C | Bal. | 1.80 | 0.300 | 1.5 | 0.7 | — | — | — | 0.18 | Broken | 61.3 |
| COMPARATIVE EXAMPLE 3 | Fe-20% (iron alloy)-0.5% Cu-0.7% C | Bal. | 0.60 | 0.100 | 0.5 | 0.7 | — | — | −1.15 | 0.80 | 0.04 | 20.2 |
| COMPARATIVE EXAMPLE 4 | Fe-20% (iron alloy)-3.0% Cu-0.7% C | Bal. | 0.60 | 0.100 | 3.0 | 0.7 | — | — | — | 0.92 | 0.06 | 20.8 |
| COMPARATIVE EXAMPLE 5 | Fe-20% (iron alloy)-9.0% Cu-0.7% C | Bal. | 0.60 | 0.100 | 9.0 | 0.7 | — | — | — | 1.38 | 0.07 | 22.1 |
| COMPARATIVE EXAMPLE 6 | Fe-20% (iron alloy)-1.5% Cu-0.3% C | Bal. | 0.60 | 0.100 | 1.5 | 0.3 | — | — | −0.60 | 1.08 | 0.03 | 20.4 |
| COMPARATIVE EXAMPLE 7 | Fe-20% (iron alloy)-1.5% Cu-1.5% C | Bal. | 0.60 | 0.100 | 1.5 | 1.5 | — | — | −1.30 | 0.62 | 0.09 | 20.6 |
| COMPARATIVE EXAMPLE 8 | Fe-6.0% Co-6.0% Ni-10% (Fe-75Mo)-0.5% C | Bal. | — | 7.500 | — | 0.5 | 6.0 | 6.0 | −1.00 | 1.00 | 0.09 | 0 |

Result 1: Optimal Amount of Iron Alloy Powder (Hard Particles)

As shown in FIG. 5, the wear amount ratio of the sintered alloys according to Examples 1 to 4 was smaller than that of Comparative Example 1. This is because in Examples 1 to 4, a larger amount of the iron alloy powder was added to the mixed powder than in Comparative Example 1 and thus the proportion of the hard particles contained in the sintered alloy was high. From this viewpoint, the addition amount of the iron alloy powder may be 15 mass % or more in the entire mixed powder, and the proportion of the hard particles of the sintered alloy may be 15.3 mass % or more in the sintered alloy (see Example 1 and the like). Moreover, since the sintered alloy of Comparative Example 1 has a small amount of Mo, it is thought that Mo oxides were less likely to be formed on the surface of the sintered alloy during use at a high temperature, and thus the effect of the Mo oxides as a solid lubricant could not be expected. From this viewpoint, the Mo content in the sintered alloy may be 0.075 mass % or more (see Example 1 and the like).

As shown in FIG. 6, the corrosion weight loss ratio of the sintered alloys according to Examples 1 to 4 was higher than that of Comparative Example 1. This is because in Comparative Example 1, a larger amount of the iron alloy powder was added to the mixed powder than in Examples 1 to 4, a passive film was formed on the surface of the sintered alloy by Cr contained in the sintered alloy, and thus the corrosion resistance of the sintered alloy was improved. From this viewpoint, the Cr content in the sintered alloy may be 0.45 mass % or more (see Example 1 and the like).

On the other hand, in the sintered alloy according to Comparative Example 2, chipping and breaking of the cutting tool had occurred in the machinability evaluation test (see Table 1). This is because in Comparative Example 2, since the proportion of the iron alloy powder was too high, the proportion of the hard particles with the martensitic structure contained in the sintered alloy was too high. From this viewpoint, the addition amount of the iron alloy powder may be 40 mass % or less in the entire mixed powder, and the proportion of the hard particles of the sintered alloy may be 40.9 mass % or less in the sintered alloy (see Example 2 and the like).

Result 2: Optimal Amount of Copper Powder (Cu)

As shown in FIG. 7, the wear amount ratio of the sintered alloys according to Examples 3 to 5 was lower than those of Comparative Examples 4 and 5. It is thought that this is because in Comparative Examples 4 and 5, a large amount of the copper powder than those of Examples 3 to 5 was added to the mixed powder and thus Mo oxide films were less likely to be formed on the surface of the sintered alloy by Cu in a high temperature usage environment. Accordingly, it is thought that in the sintered alloys according to Comparative Examples 4 and 5, adhesive wear had occurred due to metal contact with a valve as a counter member. From this viewpoint, the addition amount of the copper powder may be 1.8 mass % or less in the entire mixed powder, and the Cu content in the sintered alloy may be 1.8 mass % or less (see Example 4 and the like).

On the other hand, as shown in FIG. 8, the corrosion weight loss ratio of the sintered alloys according to Examples 3 to 5 was lower than that of Comparative Example 3. This is because in Comparative Example 3, the amount of the copper powder added to the mixed powder was too small compared to Examples 3 to 5 and thus the corrosion resistance by Cu could not be sufficiently exhibited.

In Comparative Example 3, adhesive wear had occurred in the wear resistance test. It is thought that this is because the hardness of the iron base of the sintered alloy could not be ensured by Cu, the iron base was plastically deformed due to metal contact with a valve as a counter member, and the surface thereof was pulled off. From this viewpoint, the addition amount of the copper powder may be 1.2 mass % or more in the entire mixed powder, and the Cu content in the sintered alloy may be 1.2 mass % or more (see Example 3 and the like).

Result 3: Optimal Amount of Graphite Powder (C)

As shown in FIG. 9, the wear amount ratio of the sintered alloys according to Examples 4 to 6 was smaller than that of Comparative Example 6. This is because in Comparative Example 6, the amount of the graphite powder added to the mixed powder was too small compared to Examples 4 to 6 and thus a pearlitic structure was less likely to be formed in the iron base during sintering. Accordingly, it is thought that in the iron base of the sintered alloy, the amount of the ferritic structure is large, the hardness of the sintered alloy decreases, and the wear resistance of the sintered alloy decreases. From this viewpoint, the addition amount of the graphite powder may be 0.5 mass % or more in the entire mixed powder, and the C content in the sintered alloy may be 0.5 mass % or more (see Example 5 and the like).

As shown in Table 1, the corrosion weight loss ratio of the sintered alloys according to Examples 4 to 6 was lower than that of Comparative Example 7. It is thought that this is because in Comparative Example 7, the amount of the graphite powder added to the mixed powder was too large compared to Examples 4 to 6, a large amount of Cr carbides and Mo carbides were produced in the sintered alloy, and the corrosion resistance of the sintered alloy decreased. From this viewpoint, the addition amount of the graphite powder may be 1.0 mass % or less in the entire mixed powder, and the C content in the sintered alloy may be 1.0 mass % or less.

Furthermore, as shown in Table 1, in the sintered alloy according to Examples 1 to 6, the wear amount ratio, the corrosion weight loss ratio, and the cutting tool wear amount were smaller than those of Comparative Example 8. From the results, it can be said that in Examples 1 to 6, the corrosion resistance and wear resistance could be improved at a low cost without the use of Ni, Co, and the like unlike the sintered alloy in the related art as in Comparative Example 8.

While the embodiment of the present disclosure has been described above in detail, the present disclosure is not limited to the above-described embodiment, and various changes in design can be made.

What is claimed is:

1. A manufacturing method of a wear-resistant iron-based sintered alloy comprising:

a forming step of compacting a mixed powder containing a pure iron powder, an iron alloy powder, a copper powder, and a graphite powder into a compact; and a sintering step of sintering the compact, wherein the iron alloy powder consists of, with the entire iron alloy powder being 100 mass %, Cr: 2.5 mass % to 3.5 mass %, Mo: 0.4 mass % to 0.6 mass %, and Fe and inevitable impurities as a balance, the entire mixed powder being 100 mass %, in the mixed powder, a proportion of the iron alloy powder is 15 mass % to 40 mass %, and a proportion of the copper powder is 1.2 mass % to 1.8 mass %, a proportion of the graphite powder is 0.5 mass % to 1.0 mass %, the balance is the pure iron powder, and in the sintering step, a mixed ferritic structure and pearlitic structure is produced from the pure iron powder, and a martensitic structure is produced from the iron alloy powder.

2. The manufacturing method according to claim 1, wherein, in the sintering step, the compact is heated under a condition that a heating temperature is set to 1050° C. to 1200° C. and a heating time is set to 10 minutes to 60 minutes, and the compact heated under the condition is cooled at a cooling rate of 20° C./min to 300° C./min.

3. The manufacturing method according to claim 1, wherein the wear-resistant iron-based sintered alloy comprises:

C: 0.5 mass % to 1.0 mass %;

Cr: 0.45 mass % to 1.20 mass %;

Mo: 0.075 mass % to 0.200 mass %;

Cu: 1.2 mass % to 1.8 mass %; and

Fe and inevitable impurities as a balance, wherein in the wear-resistant iron-based sintered alloy, hard particles with a martensitic structure is dispersed in an iron base with a structure in which a ferritic structure and a pearlitic structure are mixed, C and Cu are contained in the iron base and the hard particles, Cr and Mo are contained at least in the hard particles, and the entire wear-resistant iron-based sintered alloy contains 15.3 mass % to 40.9 mass % of the hard particles based on 100% mass.

* * * * *